US005799335A

United States Patent [19]

Ethier

[11] Patent Number: 5,799,335

[45] Date of Patent: Sep. 1, 1998

[54] CONVERTIBLE HAT

[75] Inventor: Robert Ethier, Saint-Philippe, Canada

[73] Assignee: Les Industries Robo-Cap Ltee, Saint-Philippe, Canada

[21] Appl. No.: 868,281

[22] Filed: Jun. 3, 1997

[51] Int. Cl.[6] ..... A42B 1/20

[52] U.S. Cl. ..... 2/209.11; 224/577; 150/100

[58] Field of Search ..... 2/171.03, 171.4, 2/171.5, 171.6, 171.7, 209.11, 209.12, 209.13, 195.1, 195.2, 195.7; 224/575, 576, 577, 578; 150/100, 103, 106

[56] References Cited

U.S. PATENT DOCUMENTS

| | | | |
|---|---|---|---|
| 1,269,594 | 6/1918 | Geraghty . | |
| 1,330,299 | 2/1920 | Ballard | 2/195.7 |
| 2,106,570 | 1/1938 | Lipton . | |
| 2,106,571 | 1/1938 | Lipton . | |
| 2,122,171 | 6/1938 | Alexander . | |
| 2,678,448 | 5/1954 | Rosenzweig . | |
| 2,708,273 | 5/1955 | Bonaventura . | |
| 2,880,422 | 7/1959 | Blauer . | |
| 3,285,307 | 11/1966 | Dormaier . | |
| 4,357,020 | 11/1982 | Van Bryant, Jr. . | |
| 4,610,038 | 9/1986 | Dennard . | |
| 5,214,802 | 6/1993 | McCallum . | |
| 5,303,427 | 4/1994 | Fishbaine . | |
| 5,367,713 | 11/1994 | McCallum . | |
| 5,450,629 | 9/1995 | Gilstrap . | |
| 5,664,257 | 9/1997 | Hall . | |

FOREIGN PATENT DOCUMENTS

| | | |
|---|---|---|
| 46309 | 3/1979 | Canada . |

*Primary Examiner*—C. D. Crowder
*Assistant Examiner*—Shirra L. Jenkins
*Attorney, Agent, or Firm*—Swabey Ogilvy Renault

[57] ABSTRACT

A convertible hat comprises a crown formed of flexible material and having a peripheral edge defining a head-receiving opening, a visor flexibly attached to the crown along a section of the peripheral edge and projecting forwardly from the crown, a removable strap extending about and exteriorly of the crown adjacent the peripheral edge, guide means for guiding and retaining the strap adjacent the peripheral edge. Releasable fastening means for releasably attaching free ends of the strap to the crown at predetermined locations on opposite sides thereof. Further releasable fasteners are also provided for releasably attaching the visor to a rear portion of the crown. The strap is arranged about the crown and attached thereto so that when the strap is pulled away from the crown in a forward or rearward direction, the opening is contracted and the crown forms a bag with the strap defining a handle for carrying the bag and the visor defining a closure flap for closing the contracted opening, the further fasteners being operative to releasably retain the closure flap in a closed position, whereby the hat is converted into a handbag.

29 Claims, 9 Drawing Sheets

CONVERTIBLE HAT

BACKGROUND OF THE INVENTION

The present invention relates to a convertible hat and, more particularly, to a hat which can be converted into a handbag, a shoulder bag and/or a pocket belt satchel, as well as into a garrison cap.

A number of prior art patents disclose a head covering which may also functions as a bag or the like. For example, U.S. Pat. No. 5,450,629 discloses a convertible hat having a shell of general hemispherical shape with an open bottom, a peripheral edge around the open bottom and an interior. A visor having an inside edge and an outside edge is flexibly attached to the shell along a section of the peripheral edge and extends substantially perpendicularly away from the shell. The visor has a plurality of fold lines extending from its inside edge to its outside edge. The fold lines allow the visor to be folded to a reduced size and tucked into the interior of the shell to form a pursue. Since the visor is folded inside the purse, the capacity of such a purse is significantly reduced so that very few and/or small objects may be carried therewith.

U.S. Pat. No. 5,214,802 discloses a convertible hat and bag assembly which is formed from a first, hat-shaped layer and a separate, bag-shaped enclosure secured around part of its area to the peripheral edge of the hat-shaped layer. The bag-shaped enclosure can be stowed inside the hat-shaped layer in order to use the assembly as a hat, while the assembly can be turned inside out with the bag-shaped enclosure outermost and the hat-shaped layer stowed inside the enclosure in order to use the assembly as a bag. When the hat-shaped layer is provided with a visor and the assembly is used as a waist or hip carried bag, the assembly is flattened and the visor is folded down over the bag opening with the bag being worn with the visor facing inwardly towards the wearer's body so that it is trapped to close the bag. Since the visor is not positively secured, it may easily be displaced upon movement of the wearer's hip or waist and become dislodged, thereby exposing the contents of the bag.

SUMMARY OF THE INVENTION

It is therefore an object of the present invention to overcome the above drawbacks and to provide a hat which may be readily converted into a bag while retaining maximum capacity of the bag.

It is another object of the invention to provide a hat which can be easily converted into several bags of different shapes and styles, as well as into a head covering of different style.

According to one aspect of the present invention, there is provided a convertible hat comprising a crown formed of flexible material and having a peripheral edge defining a head-receiving opening, a visor flexibly attached to the crown along a section of the peripheral edge and projecting forwardly from the crown, a removable strap extending about and exteriorly of the crown adjacent the peripheral edge, guide means for guiding and retaining the strap adjacent the peripheral edge, first releasable fastening means for releasably attaching free ends of the strap to the crown at predetermined locations on opposite sides thereof, and second releasable fastening means for releasably attaching the visor to a rear portion of the crown. The strap is arranged about the crown and attached thereto so that when the strap is pulled away from the crown in a forward or rearward direction, the opening is contracted and the crown forms a bag with the strap defining a handle for carrying the bag and the visor defining a closure flap for closing the contracted opening, the second fastening means being operative to releasably retain the closure flap in a closed position, whereby the hat is converted into a handbag.

Preferably, the guide means comprise first and second pairs of strap loops with the strap loops of each pair being disposed on opposite sides of the crown adjacent the peripheral edge. The strap loops of the first pair are arranged adjacent a front portion of the crown and the strap loops of the second pair are arranged adjacent the rear portion of the crown.

In a particularly preferred embodiment, the free ends of the strap are each provided with a closable hook member for engaging a respective strap loop of the first pair, the hook members and the respective strap loops defining the aforesaid first fastening means. The strap extends in overlapping relation rearwardly of the first pair of strap loops. Pulling of the strap away from the crown in a forward direction causes the hook members to draw the respective strap loops rearwardly and bring same in proximity to the strap loops of the second pair, thereby contracting the opening.

According to another aspect of the invention, there is provided a hat as defined above which further includes a pair of strap attachment means disposed on opposite sides of the crown adjacent the peripheral edge and in spaced relation to the aforesaid predetermined locations, the strap attachment means being adapted to cooperate with the first fastening means in a manner such that when the strap is removed from the crown and the free ends of the strap are attached to the crown with the first fastening means and further attached to the crown with the strap attachment means, the strap attachment are brought in proximity to the predetermined locations so that the opening is contracted and the crown forms another bag with the strap defining a shoulder strap for carrying such other bag and the visor defining the aforesaid closure flap, whereby the hat is converted into a shoulder bag.

In a preferred embodiment, the strap loops of the aforesaid second pair define the strap attachment means for engagement by the aforesaid hook members, whereby when the hook members are engaged with the strap loops of the first pair and the strap loops of the second pair, the strap loops of the first and second pairs are brought in close proximity to one another, thereby contracting the opening.

According to a further aspect of the invention, there is provided a hat as defined above wherein the crown comprises a body and a substantially flat top joined to the body along a peripheral fold line, the body having a generally rectangular configuration with a front portion, the aforesaid rear portion and a pair of opposite side portions, the top being provided with a pocket defining an elongated access opening extending transversely of the body. The second fastening means are positioned relative to the fold line so that when the strap is removed from the crown to define a waist belt and the visor is attached with the second fastening means to the rear portion, the front and rear portions are folded inwradly along respective front and rear sections of the fold line and define together with the visor a belt loop for receiving therethrough the waist belt, the side portions being adapted to be folded inwardly along opposite lateral sections of the fold line so as to extend into the belt loop and overlap with one another, whereby the hat is converted into a pocket bait satchel.

According to yet another aspect of the invention, there is provided a hat as defined above which includes third releasable fastening means for releasably attaching the visor to a front portion of the crown when the visor is folded upwardly along the aforesaid section of the peripheral edge, whereby the hat is converted into a garrison cap.

The hat of the invention can therefore be converted into several bags of different shapes and styles without reducing the capacities of the bags thus formed, as well as into a hat of different style.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
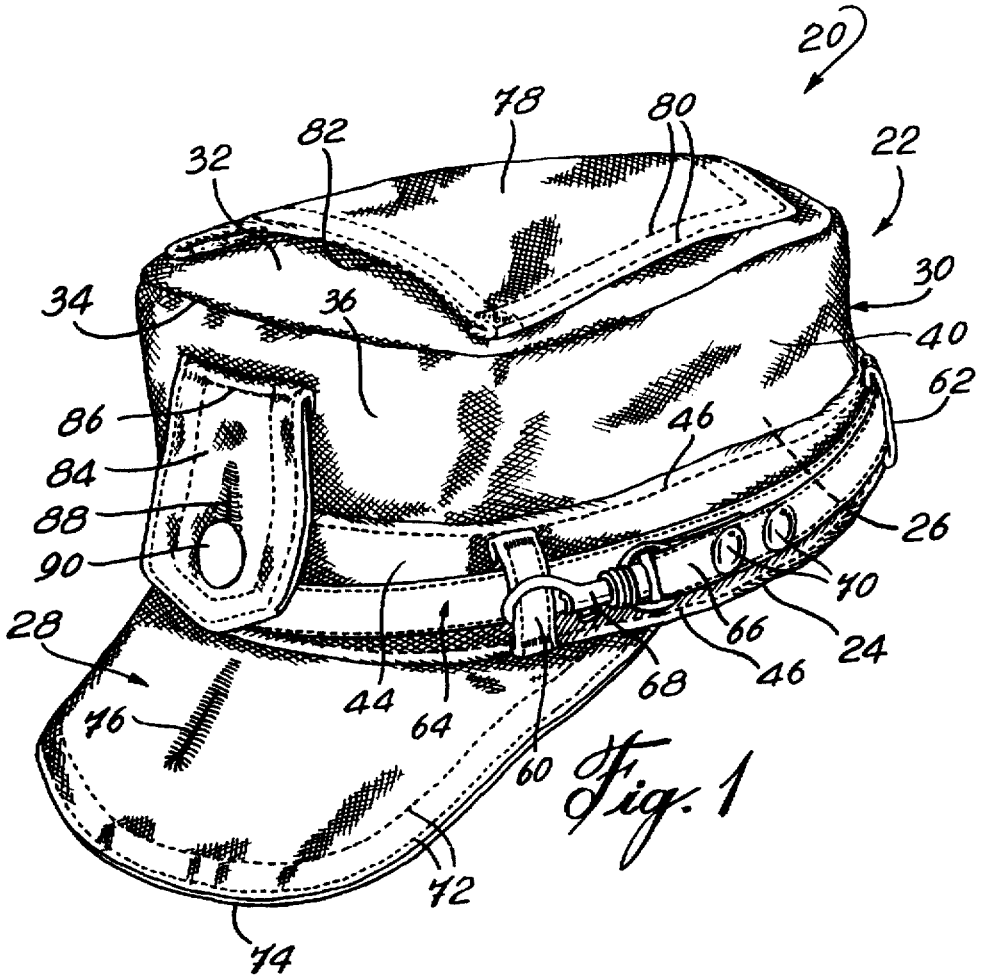
FIG. 1 is a front perspective view of a convertible hat according to a preferred embodiment of the invention.
Figure 2:
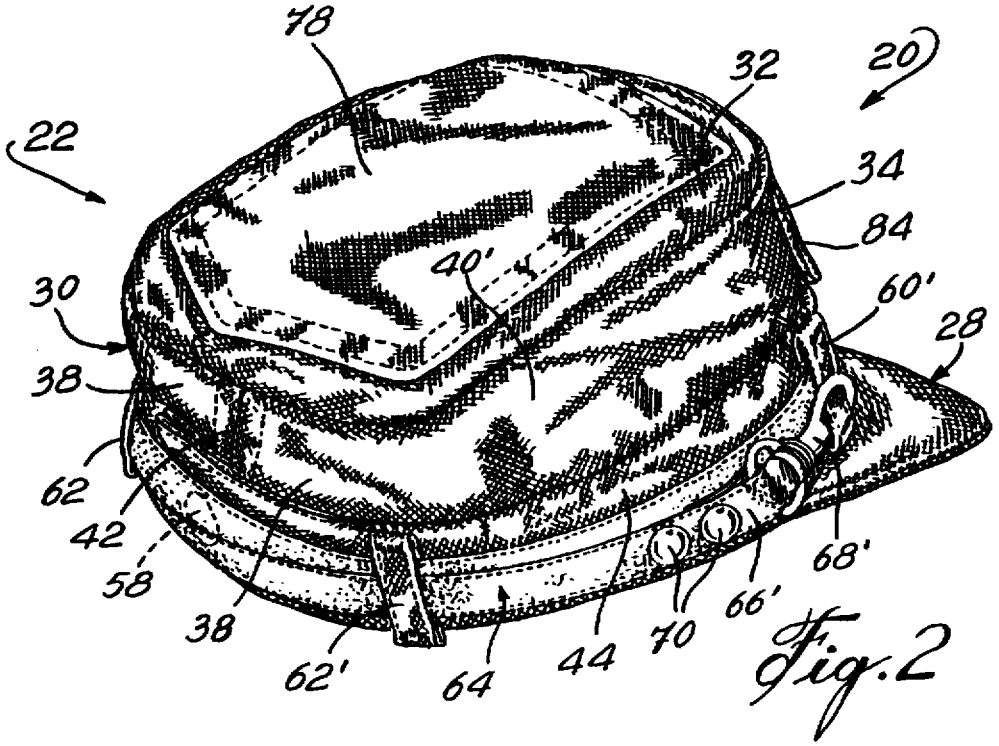
FIG. 2 is a rear perspective view thereof.
Figure 3:
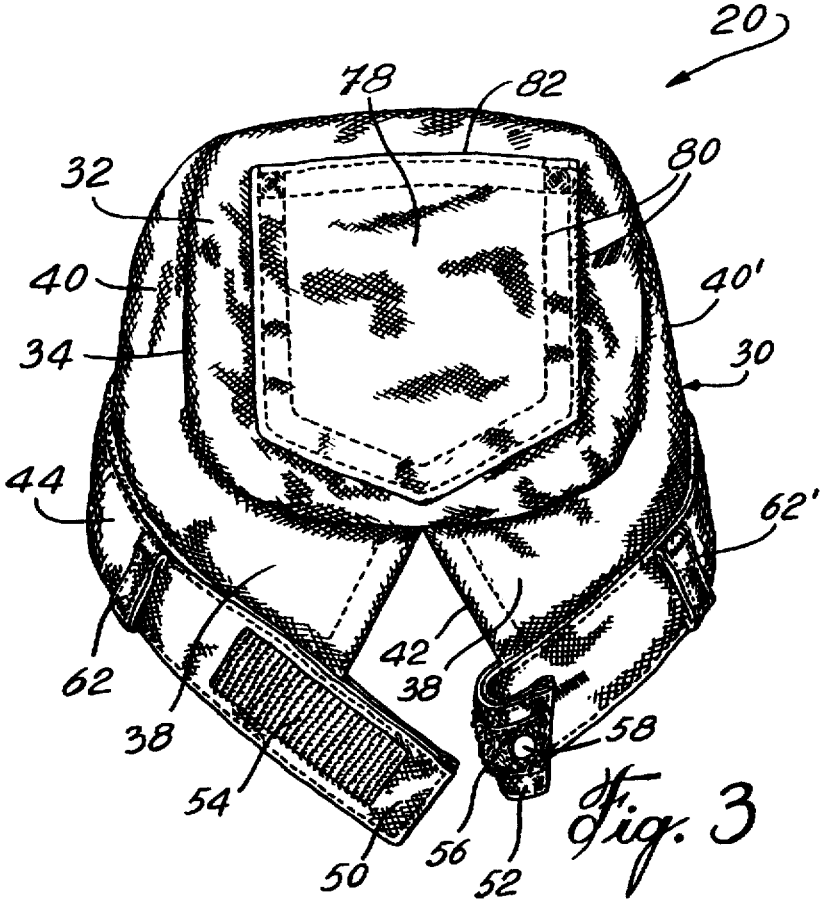
FIG. 3 is another rear perspective view of the hat, without the strap.

Referring first to FIGS. 1–3, there is illustrated a convertible hat in the form of a cap which is generally designated by referenced numeral 20. The vap 20 comprises a crown 22 of fabric material having a peripheral edge 24 defining a head-receiving opening 26, and a visor 28 of fabric material attached to the crown 22 along a section of the peripheral edge 24. As shown, the crown 22 has a body 30 of rectangular configuration and a substantially flat top wall 32 which is joined to the body 30 by a peripheral seam 34. The body 30 includes a front portion 36, a rear portion 38 and a pair of opposite side portions 40,40', a notch 42 being formed in the rear portion 38.

The body 30 is provided with a peripheral band 44 which extends adjacent the edge 24 and is secured by stichings 46 to the front, rear and side portions 36,38,40,40' as well as to a head liner 48 (shown in FIGS. 5, 7, 13 and 14) extending inside the crown 22 and parallel to the band 44. As shown in FIG. 3, the band 44 extends beyond opposite sides of the notch 42 to define a pair of tabs 50 and 52 which have adjustable fasteners such as VELCRO (trade mark) strips 54 and 56 for adjusting the size of the cap. The tab 52 is provided with a button 58. Two pairs of strap loops 60,60' and 62,62' extend transversely across the band 44, the strap loops 60,60' being disposed adjacent the front portion 36 of the crown and the strap loops 62,62' adjacent the rear portion 38 thereof. A removable strap 64 extends over the band 44 and through the strap loops 60,60',62,62', the free ends 66,66' of the strap 64 being relasably attached to the strap loops 60 and 60' by means of closable hook members 68 and 68' of swivel type. The strap 64 extends in overlapping relation rearwardly of the strap loops 60,60', as best shown in FIG. 2. Adjustable snap fasteners 70 are provided at the free ends 66,66' of the strap 64 for adjustably varying the length therof.

The strap loops 60,60' and 62,62' are disposed on opposite sides of the crown 22 symetrically with respect to a longitudinal symetry plane (not shown). The strap loops 60 and 60' are spaced from one another along a front section of the edge 24 by a distance which is substantially equal to the distance by which the strap loops 62 and 62' are spaced from one another along a rear section of the edge 24. The strap loops 60,60',62,62' guide the strap 64 and retain same adjacent the peripheral edge 24.

The visor 28 is formed of two plies of fabric material which are secured together by a double stitching 72 extending adjacent the edge 74 of the visor. An elongated buttonhole 76 is formed through the visor 28 substantially centrally thereof.

A patch pocket 78 is attached to the top wall 32 of the crown 22 by a double stitching 80. The pocket 78 has an elongated access opening 82 extending transversely of the body 30. A front central flap 84 of pentagonal outline is attached to the body 30 by a stitching 86. The flap 84 has an elongated buttonhole 88 through which extends a button 90 fixed to the band 44 and head liner 48.

Figure 4:
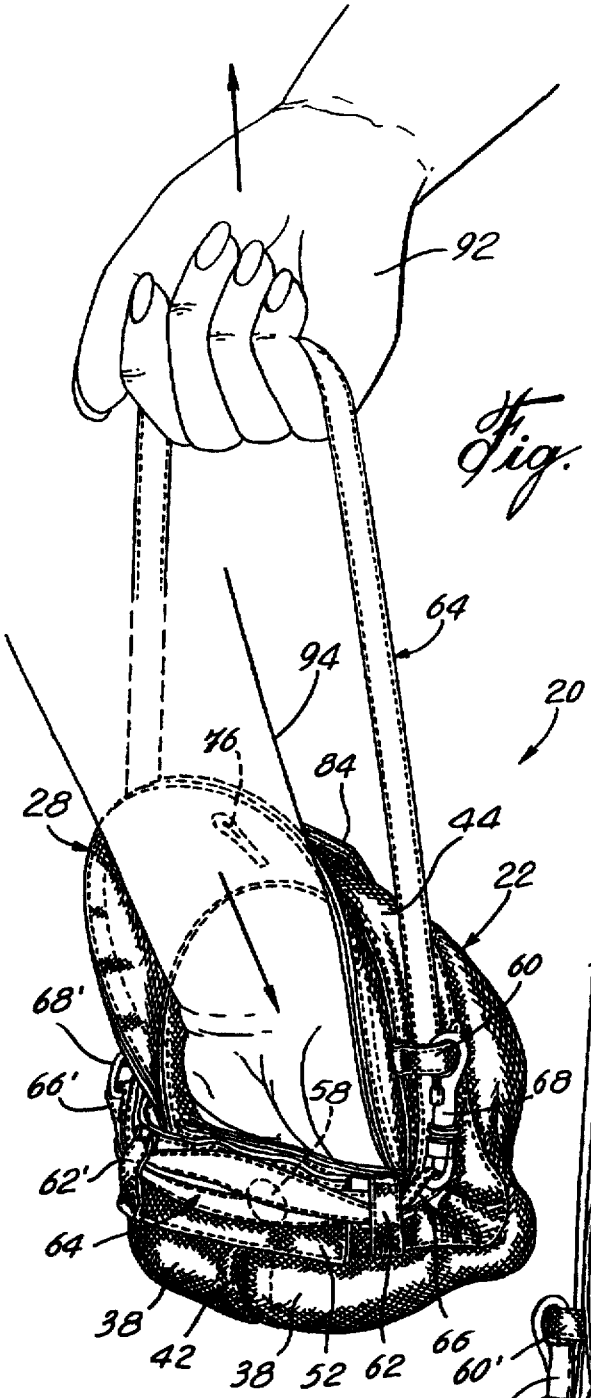
FIG. 4 is a perspective view illustrating how the hat of FIG. 1 can be converted into a handbag.
Figure 5:
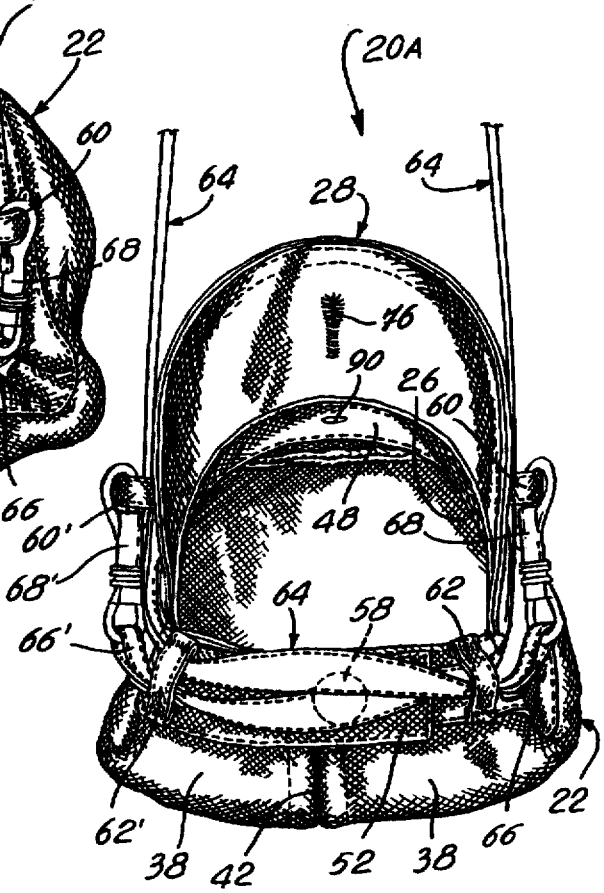
FIG. 5 is a front elevational view of the handbag with its closure flap in an open position.
Figure 6:
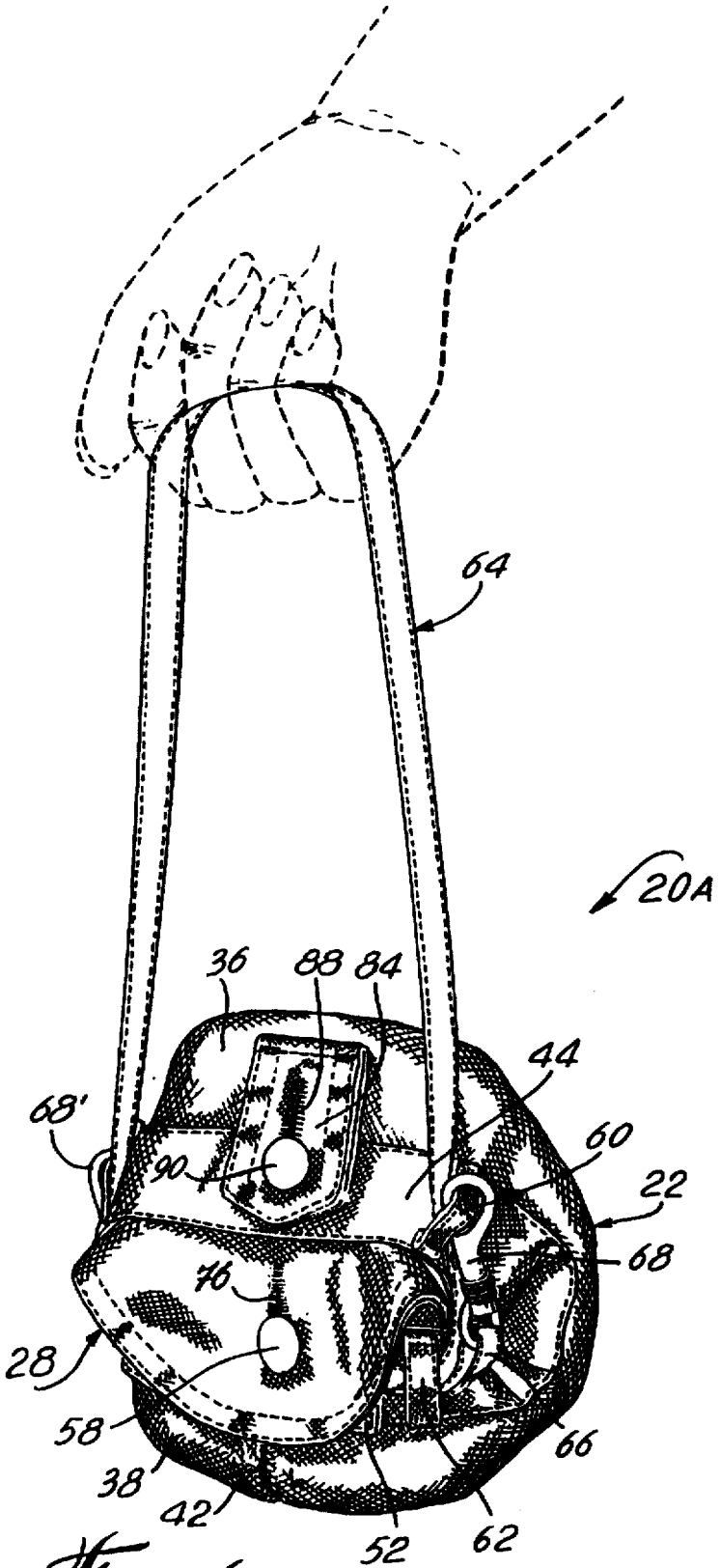
FIG. 6 is a front perspective view of the handbag of FIG. 5, but with its closure flap in a closed position.
Figure 7:
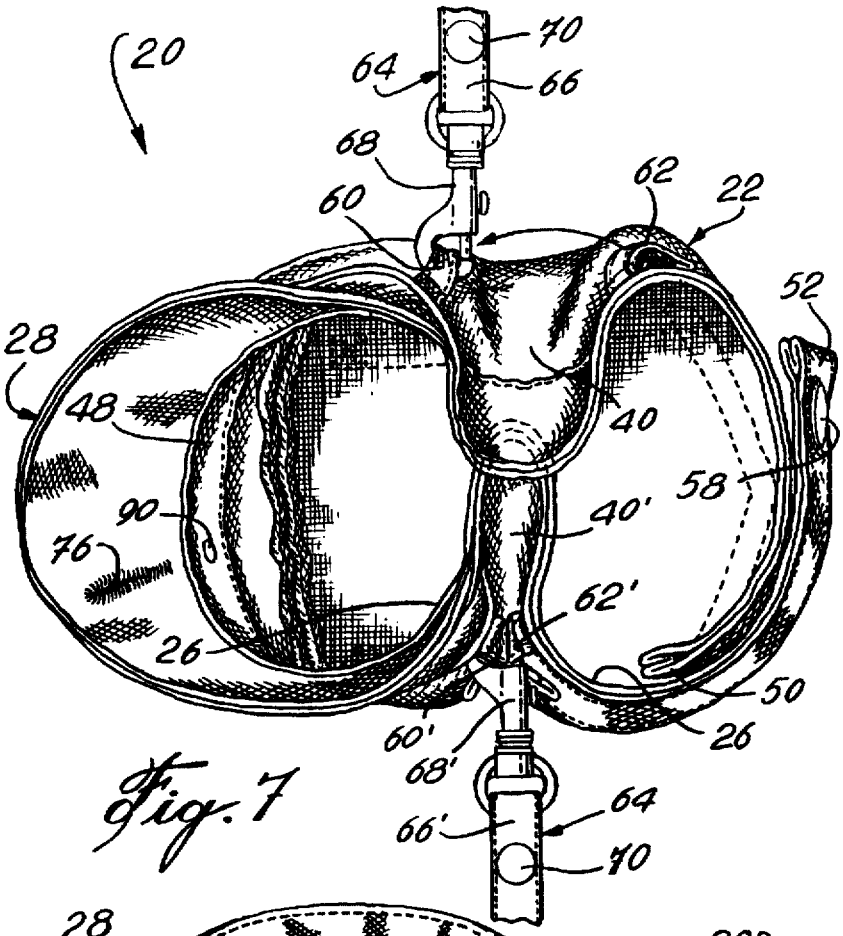
FIG. 7 is top plan view of the hat of FIG. 1 turned up-side-down, illustrating how the hat can be converted into a shoulder bag.
Figure 8:
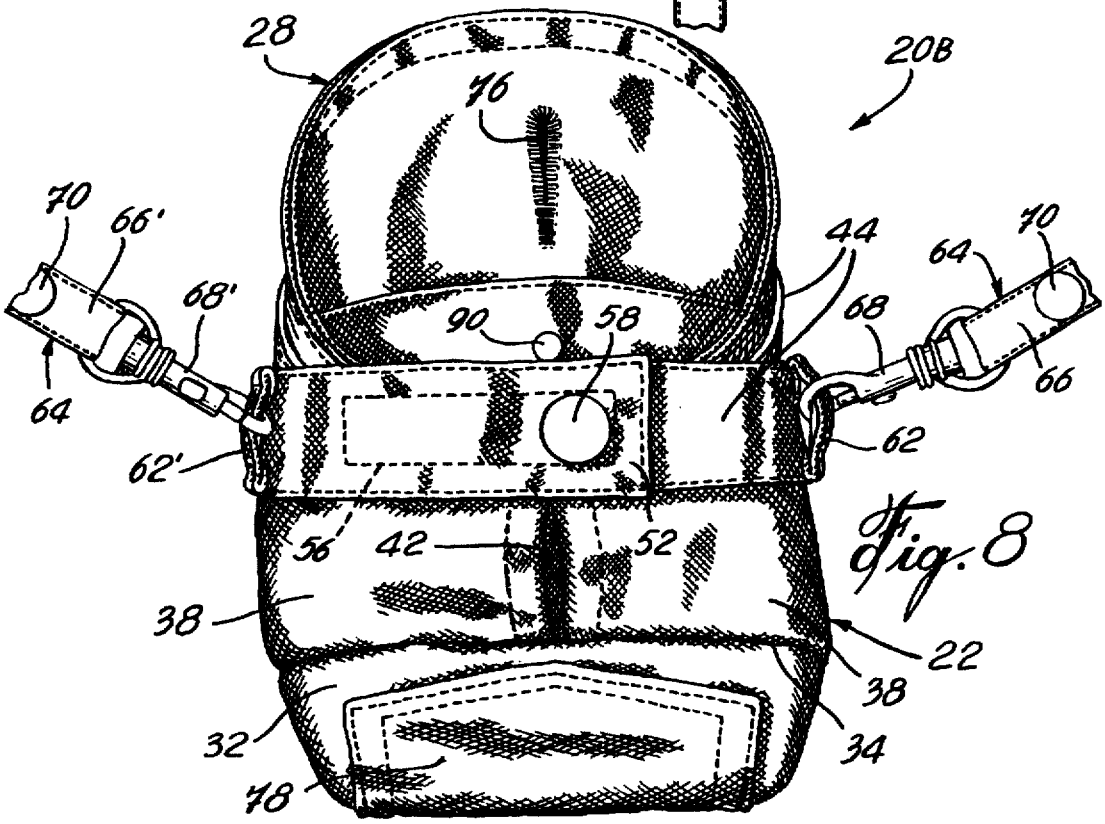
FIG. 8 is a front elevational view of the shoulder bag with its closure flap in an open position.

FIGS. 4–6 illustrate how the cap 20 can be converted into a handbag 20A. As shown, by pulling with one hand 92 the strap 64 away from the crown 22 in a forward direction and inserting the other hand 94 inside the crown 22 to retain the cap 20 against the pulling force exerted by the hand 92, one causes the hook members 68,68' to draw the strap loops 60,60' rearwardly and bring same in proximity to the strap loops 62,62', thereby contracting the opening 26 and transforming the crown 22 into a bag. The strap 64 thus defines a handle for carrying such a bag. The visor 28, on the other hand, functions as a closure flap for closing the contracted opening, the closure flap being releasably retained in a closed position by means of the button 58 and buttonhole 76, as shown in FIG. 6.

The same result can be obtained by attaching the hook members 68,68' to the strap loops 62,62' and arranging the strap 64 about the band 44 in a manner such that the strap 64 extends in overlapping relation forwardly of the strap loops 62,62'. Thus, pulling of the strap 64 away from the crown 22 in a rearward direction causes the hook members 68,68' to draw the strap loops 62,62' forwardly and bring same in proximity to the strap loops 60,60', thereby contracting the opening 26.

Figure 9:
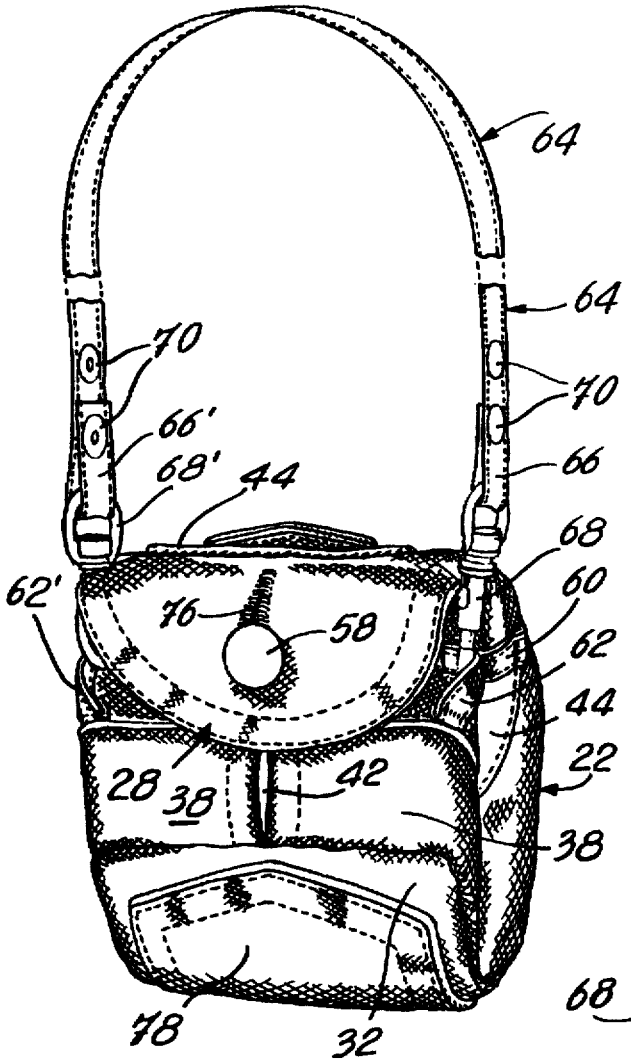
FIG. 9 is a front perspective view of the shoulder bag of FIG. 8, but with its closure flap in a closed position.
Figure 10:
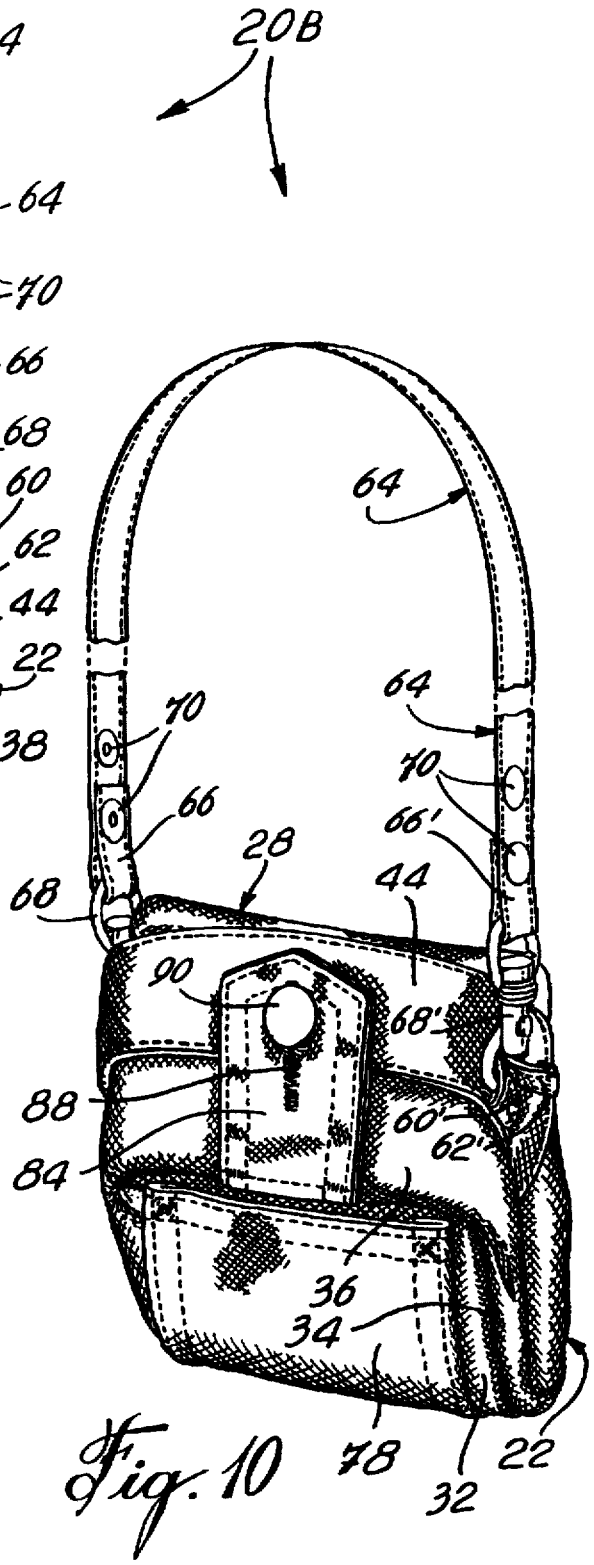
FIG. 10 is a rear perspective view thereof.
Figure 11:
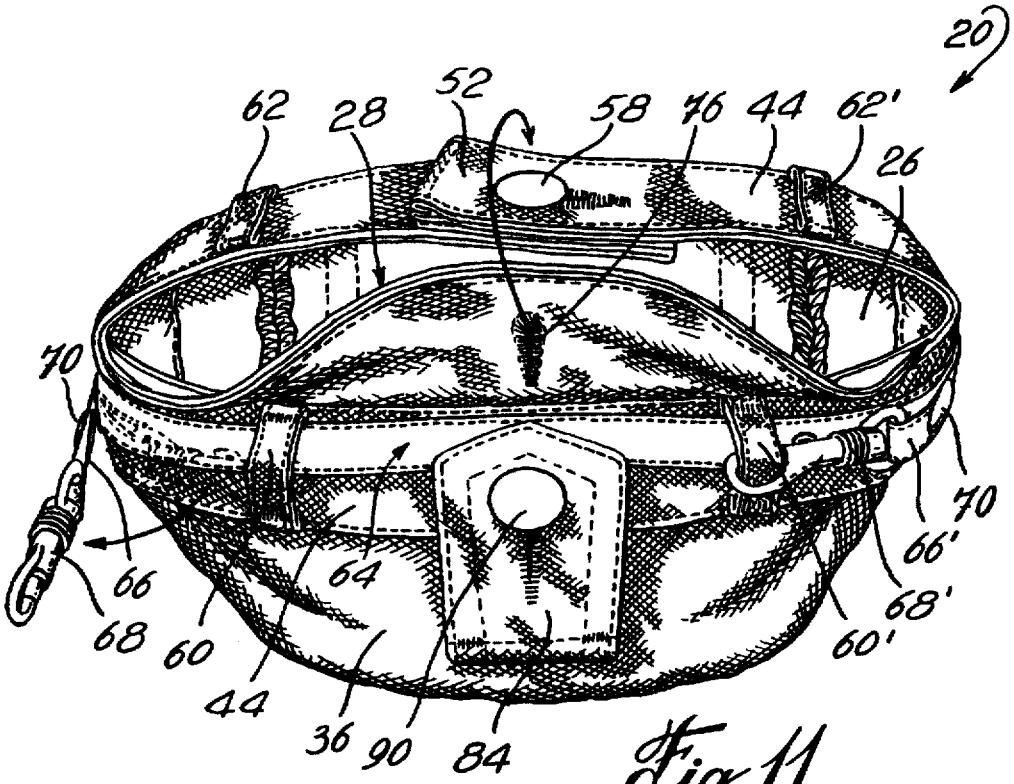
FIG. 11 is a front perspective view of the hat of FIG. 1 turned up-side-down, illustrating how the hat can be converted into a pocket belt satchel.

FIGS. 7–10 illustrate how the cap 20 can be converted into a shoulder bag 20B. As shown, by removing the strap 64 from the crown 22 and attaching the hook member 68 to both strap loops 60 and 62 and the hook member 68' to both strap loops 60' and 62', the strap loops 60,60' and 62,62' are brought in proximity to one another so that the opening 26 is contracted and the crown 22 is transformed into another bag. The strap 64 thus defines a shoulder strap for carrying such a bag. The visor 28 also functions as a closure flap for closing the contracted opening, the closure flap being releasably retained in a closed position by means of the button 58 and buttonhole 76, as shown in FIG. 9.

Figure 12:
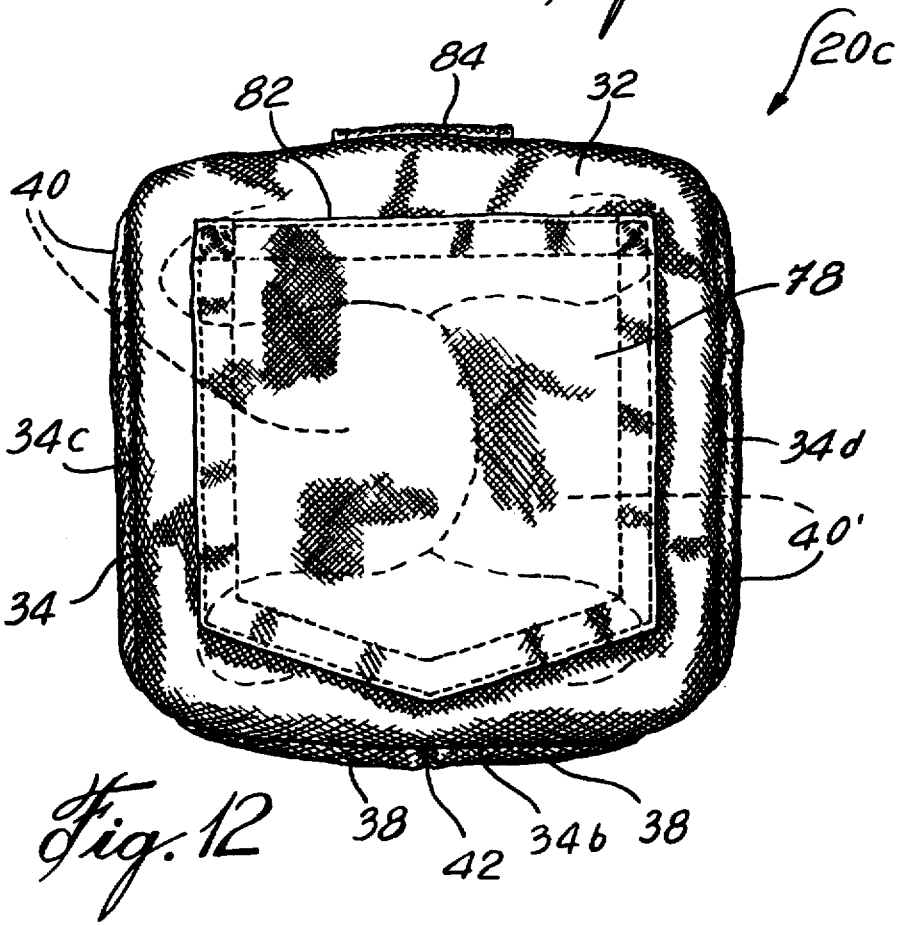
FIG. 12 is a front elevational view of the pocket belt satchel.
Figure 13:
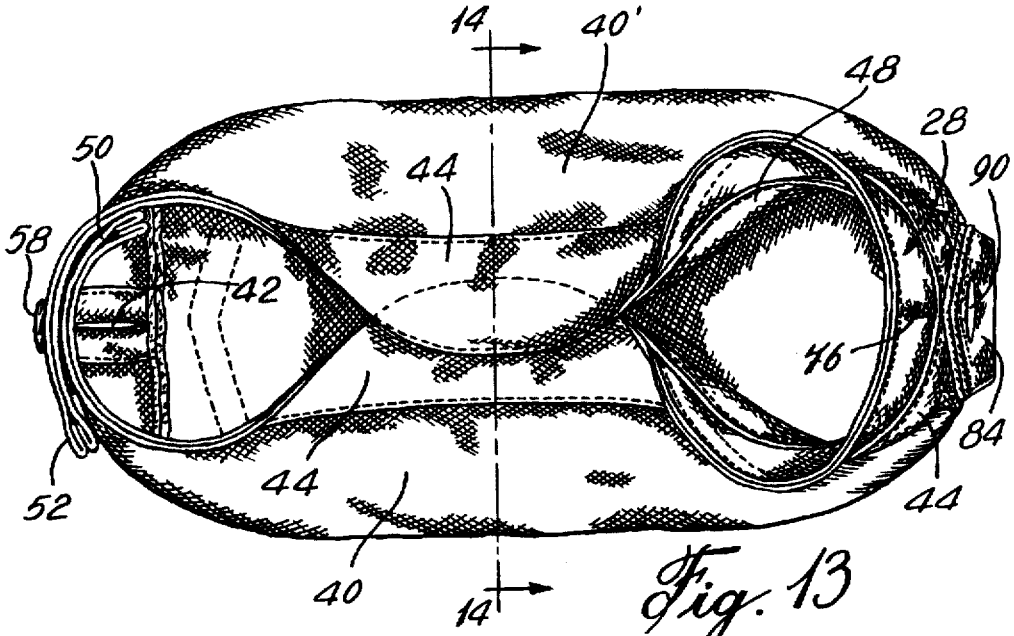
FIG. 13 is a top plan view of the hat turned up-side-down and without the strap, illustrating how the side portions of the crown are folded inwardly to form the desired belt satchel.
Figure 14:
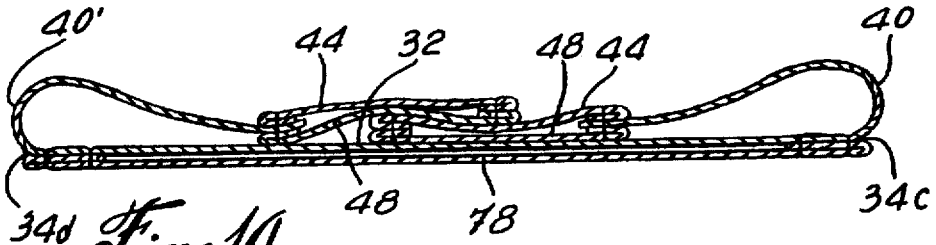
FIG. 14 is a sectional view taken along line 14—14 of FIG. 13.
Figure 15:
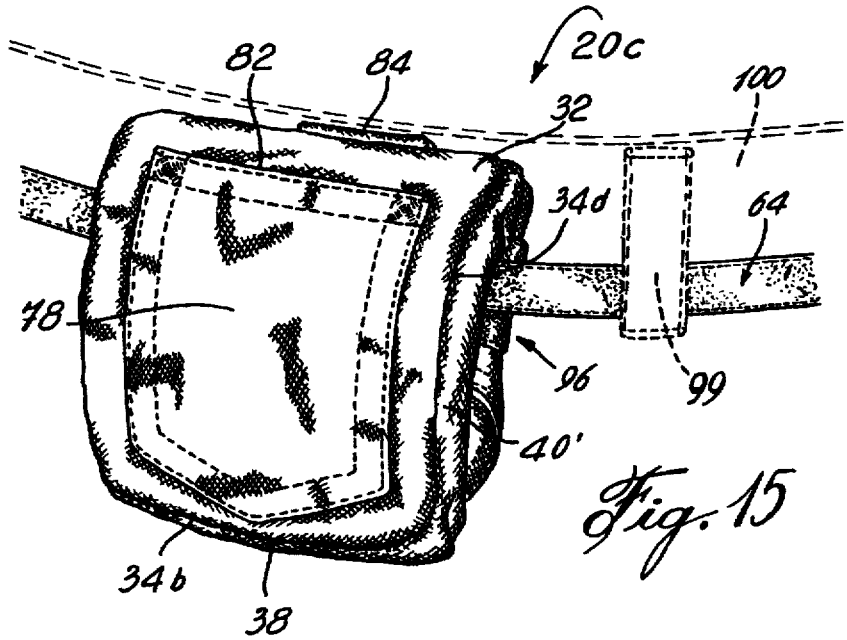
FIG. 15 is a front perspective view of the pocket belt satchel shown mounted on the strap used as a waist belt.
Figure 17:
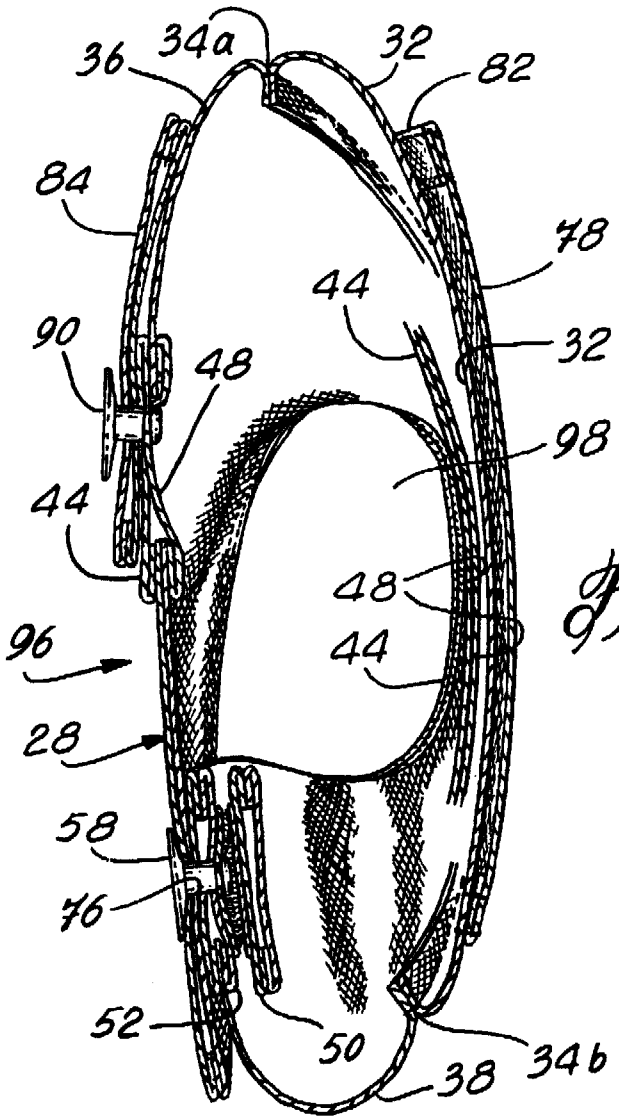
FIG. 17 is a sectional view taken along line 17—17 of FIG. 16.
Figure 16:
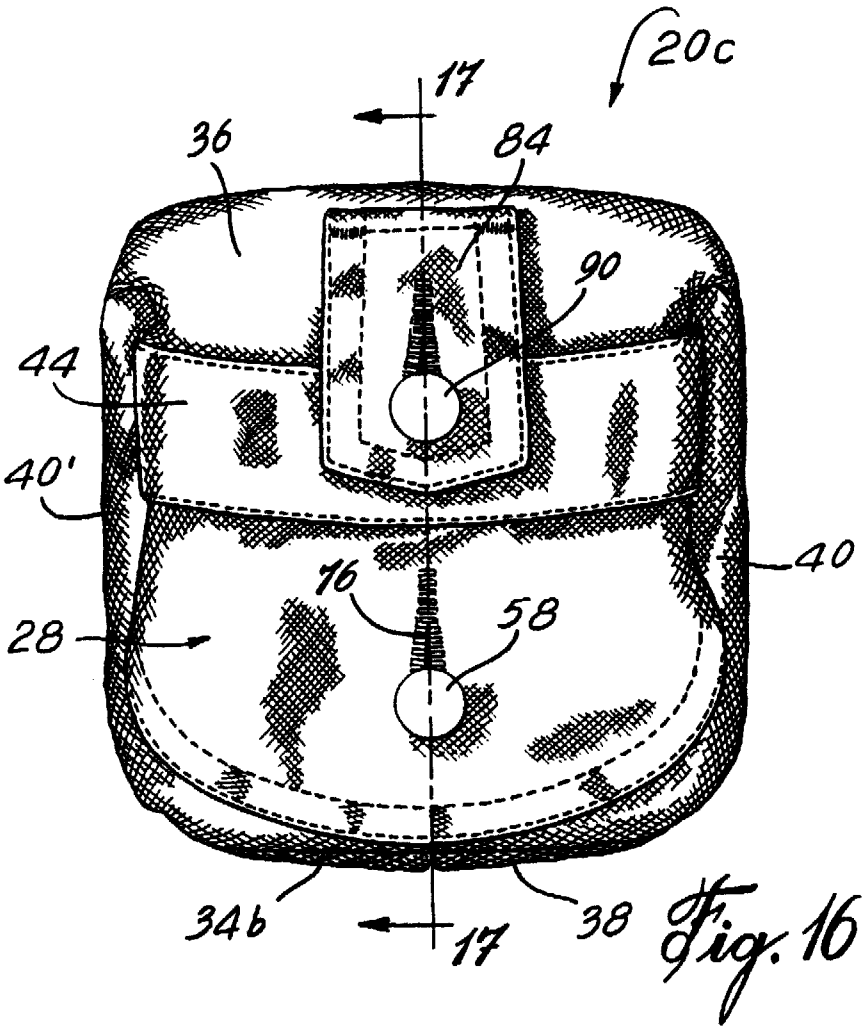
FIG. 16 is a rear elevational view of the pocket belt satchel of FIG. 12.

FIGS. 11–17 illustrate how the cap 20 can be converted into a pocket belt satchel 20C. First, the strap 64 is removed from the crown 22 to define a waist belt. The visor 28 is then attached to the rear portion 38 of the crown 22 by means of the button 58 and buttonhole 76, thereby causing the front and rear portions of the crown 22 to fold inwardly along the front and rear sections 34*a*,34*b* of the seam 34 and to define together with the visor 28 a belt loop 96 with an aperture 98 for receiving therethrough the waist belt, as shown in FIG. 17. The side portions 40,40' of the crown 22 are thereafter folded inwardly along the lateral sections 34*c*,34*d* of the seam 34 so as to extend into the belt loop 96, as shown in FIG. 12. Thus, the seam 34 acts as a fold line permitting the front, rear and side portions 36,38,40,40' to be folded inwardly. As shown in FIGS. 13 and 14, the side portions 40,40', band 44 and liner 48 are dimensioned so that when the side portions 40,40' are folded along the lateral sections 34*c*,34*d* of the seam 34, they overlapp with one another. Such an overlapping arrangement contributes to stiffening the back of the satchel 20C. The pocket belt satchel 20C can be positioned at one's waist with the strap 64 extending through the belt loops 99 of one's pants 100, as shown in FIG. 15. Small objects can thus be placed in the pocket 78 of the satchel 20C.

Figure 18:
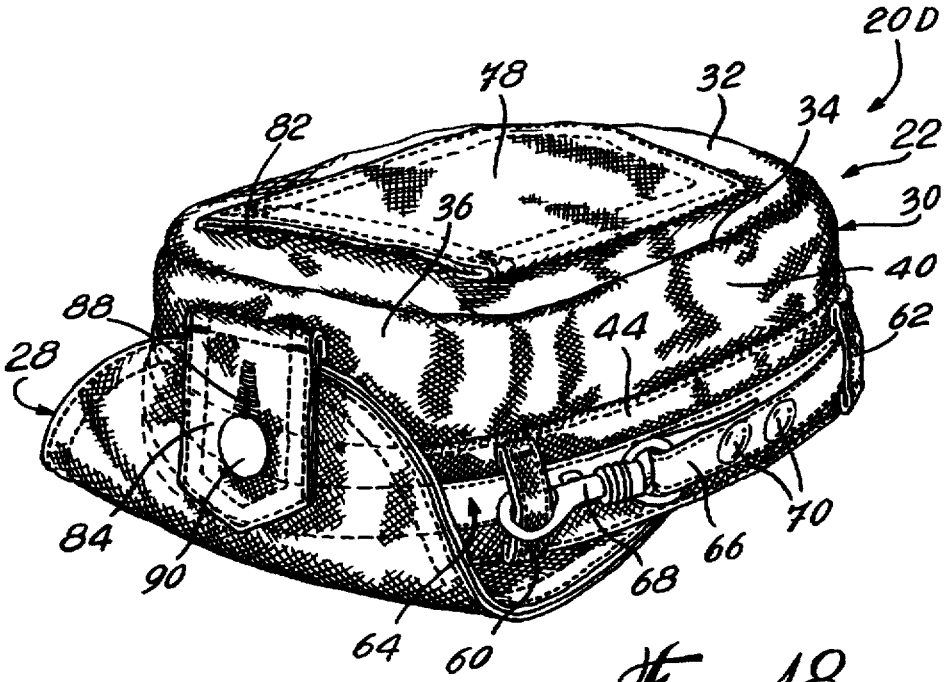
FIG. 18 which is on the same sheet of drawings as FIG. 3 is a front perspective view of the hat of FIG. 1 converted into a garrison cap.

FIG. 18 illustrates the cap in a garrison cap configuration 20D. As shown, the visor 28 is folded upwardly and extends between the front portion 36 of the crown 22 and the flap 84. The visor 28 is retained in such a position by the button 90 which extends through the buttonhole 76 (not shown) of the visor and through the buttonhole 88 of the flap 84. Thus, the cap 20 may also be converted into a cap 20D of the different style, in addition to being convertible into a handbag 20A, a shoulder bag 20B and pocket belt satchel 20C.

The crown 22 and visor 28 of the cap 20 are advantageously formed of fabric material such as denim which ensures flexibility and durability. When denim is used, it preferably has a weight of about 14 oz/yard to provide proper stiffness.

I claim:

1. A convertible hat comprising a crown formed of flexible material and having a peripheral edge defining a head-receiving opening, a visor flexibly attached to said crown along a section of said peripheral edge and projecting forwardly from said crown, a removable strap extending about and exteriorly of said crown adjacent said peripheral edge, guide means for guiding and retaining said strap adjacent said peripheral edge, first releasable fastening means for releasably attaching free ends of said strap to said crown at predetermined locations on opposite sides thereof, and second releasable fastening means for releasably attaching said visor to a rear portion of said crown, said strap being arranged about said crown and attached thereto so that when said strap is pulled away from said crown in a forward or rearward direction, said opening is contracted and said crown forms a bag with said strap defining a handle for carrying said bag and said visor defining a closure flap for closing the contracted opening, said second fastening means being operative to releasably retain said closure flap in a closed position, whereby said hat is converted into a handbag.

2. A convertible hat as claimed in claim 1, wherein said guide means comprise first and second pairs of strap loops with the strap loops of each pair being disposed on opposite sides of said crown adjacent said peripheral edge.

3. A convertible hat as claimed in claim 2, wherein the strap loops of said first pair are arranged adjacent a front portion of said crown and the strap loops of said second pair are arranged adjacent said rear portion of said crown.

4. A convertible hat as claimed in claim 3, wherein the strap loops of each said pair are disposed symmetrically with respect to a longitudinal symmetry plane.

5. A convertible hat as claimed in claim 4, wherein the straps loops of said first pair are spaced from one another along a front section of said peripheral edge by a first distance and the strap loops of said second pair are spaced from one another along a rear section of said peripheral edge by a second distance, and wherein said first and second distances are substantially equal.

6. A convertible hat as claimed in claim 5, wherein said predetermined locations correspond to the strap loops of said first pair.

7. A convertible hat as claimed in claim 5, wherein the free ends of said strap are each provided with a closable hook member for engaging a respective strap loop of said first pair, said hook members and said respective strap loops defining said first fastening means, and wherein said strap extends in overlapping relation rearwardly of said first pair of strap loops, whereby pulling of said strap away from said crown in a forward direction causes said hook members to draw said respective strap loops rearwardly and bring same in proximity to the strap loops of said second pair, thereby contracting said opening.

8. A convertible hat as claimed in claim 1, wherein said rear portion of said crown is provided with a button for engaging a buttonhole formed through said visor, said button and buttonhole defining said second fastening means.

9. A convertible hat as claimed in claim 8, wherein a notch is formed in said rear portion of said crown and a pair of tabs extend from opposite sides of said notch, said tabs being provided with adjustable fastening means for adjustably fastening said tabs together to thereby adjust hat size.

10. A convertible hat as claimed in claim 9, wherein one of said tab is provided with said button.

11. A convertible hat as claimed in claim 1, further including a pair of strap attachment means disposed on opposite sides of said crown adjacent said peripheral edge and in spaced relation to said predetermined locations, said strap attachment means being adapted to cooperate with said first fastening means in a manner such that when said strap is removed from said crown and the free ends of said strap are attached to said crown with said first fastening means and further attached to said crown with said strap attachment means, said strap attachment means are brought in proximity to said predetermined locations so that said opening is contracted and said crown forms another bag with said strap defining a shoulder strap for carrying said other bag and said visor defining said closure flap, whereby said hat is converted into a shoulder bag.

12. A convertible hat as claimed in claim 11, wherein said guide means comprise first and second pairs of strap loops with the strap loops of each pair being disposed on opposite sides of said crown adjacent said peripheral edge.

13. A convertible hat as claimed in claim 12, wherein said the strap loops of said first pair are arranged adjacent a front portion of said crown and the strap loops of said second pair are arranged adjacent said rear portion of said crown.

14. A convertible hat as claimed in claim 13, wherein the strap loops of each said pair are disposed symmetrically with respect to a longitudinal symmetry plane.

15. A convertible hat as claimed in claim 14, wherein the strap loops of said first pair are spaced from one another along a front section of said peripheral edge by a first distance and the strap loops of said second pair are spaced from one another along a rear section of said peripheral edge by a second distance, and wherein said first and second distances are substantially equal.

16. A convertible hat as claimed in claim 15, wherein the free ends of said strap are each provided with a closable hook member for engaging a respective strap loop of one of said pairs, said hook members and said respective strap loops defining said first fastening means, and wherein said strap loops of the other pair define said strap attachment means for engagement by said hook members, whereby when said hook members are engaged with the strap loops of said one pair and the strap loops of said other pair, the strap loops of said first and second pairs are brought in proximity to one another, thereby contracting said opening.

17. A convertible hat as claimed in claim 11, wherein said rear portion of said crown is provided with a button for engaging a buttonhole formed through said visor, said button and buttonhole defining said second fastening means.

18. A convertible hat as claimed in claim 17, wherein a notch is formed in said rear portion of said crown and a pair of tabs extend from opposite sides of said notch, said tabs being provided with adjustable fastening means for adjustably fastening said tabs together to thereby adjust hat size.

19. A convertible hat as claimed in claim 17, wherein one of said tab is provided with said button.

20. A convertible hat as claimed in claim 1, wherein said crown comprises a body and a substantially flat top joined to said body along a peripheral fold line, said body having a generally rectangular configuration with a front portion, said rear portion and a pair of opposite side portions, said top being provided with a pocket defining an elongated access opening extending transversely of said body, and wherein said second fastening means are positioned relative to said fold line so that when said strap is removed from said crown to define a waist belt and said visor is attached with said second fastening means to said rear portion, said front and rear portions are folded inwardly along respective front and rear sections of said fold line and define together with said visor a belt loop for receiving therethrough said waist belt, said side portions being adapted to be folded inwardly along opposite lateral sections of said fold line so as to extend into said belt loop and overlap with one another, whereby said hat is converted into a pocket belt satchel.

21. A convertible hat as claimed in claim 20, wherein a notch is formed in said rear portion and a pair of tabs extend from opposite sides of said notch, said tabs being provided with adjustable fastening means for adjustably fastening said tabs together to thereby adjust hat size.

22. A convertible hat as claimed in claim 21, wherein one of said tab is provided with a button for engaging a buttonhole formed through said visor, said button and buttonhole defining said second fastening means.

23. A convertible hat as claimed in claim 20, wherein the access opening of said pocket is disposed adjacent said front portion.

24. A convertible hat as claimed in claim 1, further including third releasable fastening means for releasably attaching said visor to a front portion of said crown when said visor is folded upwardly along said section of said peripheral edge, whereby said hat is converted into a garrison cap.

25. A convertible hat as claimed in claim 5, further including third releasable fastening means for releasably attaching said visor to a front portion of said crown when said visor is folded upwardly along said section of said peripheral edge, whereby said hat is converted into a garrison cap.

26. A convertible hat as claimed in claim 20, wherein said front portion is provided with a further button for engaging said buttonhole, said further button and said buttonhole defining said third fastening means.

27. A convertible hat as claimed in claim 1, wherein said strap is provided with means for adjustably varying the length thereof.

28. A convertible hat comprising a crown formed of flexible material and having a peripheral edge defining a head-receiving opening, a visor flexibly attached to said crown along a section of said peripheral edge and projecting forwardly from said crown, a removable strap extending about and exteriorly of said crown adjacent said peripheral edge, guide means for guiding and retaining said strap adjacent said peripheral edge, first releasable fastening means for releasably attaching free ends of said strap to said crown at predetermined locations on opposite sides thereof, second releasable fastening means for releasably attaching said visor to a rear portion of said crown, and a pair of strap attachment means disposed on opposite sides of said crown adjacent said peripheral edge and in spaced relation to said predetermined locations, said strap attachment means being adapted to cooperate with said first fastening means in a manner such that when said strap is removed from said crown and the free ends of said strap are attached to said crown with said first fastening means and further attached to said crown with said strap attachment means, said strap attachment means are brought in proximity to said predetermined locations so that said opening is contracted and said crown forms a bag with said strap defining a shoulder strap for carrying said bag and said visor defining a closure flap for closing the contracted opening, said second fastening means being operative to releasably retain said closure flap in a closed position, whereby said hat is converted into a shoulder bag.

29. A convertible hat comprising a crown formed of flexible material and having a peripheral edge defining a head-receiving opening, a visor flexibly attached to said crown along a section of said peripheral edge and projecting forwardly from said crown, and releasable fastening means for releasably attaching said visor to a rear portion of said crown, wherein said crown comprises a body and a substantially flat top joined to said body along a peripheral fold line, said body having a generally rectangular configuration with a front portion, said rear portion and a pair of opposite side portions, said top being provided with a pocket defining an elongated access opening extending transversely of said body, and wherein said fastening means are positioned relative to said fold line so that when said visor is attached with second fastening means to said rear portion, said front and rear portions are folded inwardly along respective front and rear sections of said fold line and define together with said visor a belt loop for receiving therethrough a waist belt, said side portions being adapted to be folded inwardly along opposite lateral sections of said fold line so as to extend into said belt loop and overlap with one another, whereby said hat is converted into a pocket belt satchel.

* * * * *